US010959593B2

(12) United States Patent
Du et al.

(10) Patent No.: US 10,959,593 B2
(45) Date of Patent: Mar. 30, 2021

(54) FLOOR CLEANER AND WATER SINK STRUCTURE THEREOF

(71) Applicant: Hubei Dstech Co. Ltd, Ezhou (CN)

(72) Inventors: Cong Du, Guangdong (CN); Yuandong Du, Guangdong (CN)

(73) Assignee: HUBEI DSTECH CO. LTD, Ezhou (CN)

( * ) Notice: Subject to any disclaimer, the term of this patent is extended or adjusted under 35 U.S.C. 154(b) by 92 days.

(21) Appl. No.: 16/424,515

(22) Filed: May 29, 2019

(65) Prior Publication Data

US 2019/0274511 A1 Sep. 12, 2019

(30) Foreign Application Priority Data

Jun. 14, 2018 (CN) ..... 201820929106.3

(51) Int. Cl.
*A47L 11/292* (2006.01)
*A47L 11/40* (2006.01)
*A47L 11/24* (2006.01)

(52) U.S. Cl.
CPC ..... *A47L 11/4041* (2013.01); *A47L 11/24* (2013.01); *A47L 11/292* (2013.01); *A47L 11/4016* (2013.01); *A47L 11/4088* (2013.01)

(58) Field of Classification Search
CPC .. A47L 11/282; A47L 11/292; A47L 11/4016; A47L 11/4041; A47L 11/4083; A47L 11/4088
See application file for complete search history.

(56) References Cited

U.S. PATENT DOCUMENTS

2014/0208527 A1* 7/2014 Lin ..... A47L 11/4088 15/4

FOREIGN PATENT DOCUMENTS

EP 2 641 524 A1 * 9/2013

* cited by examiner

*Primary Examiner* — Randall E Chin

(57) ABSTRACT

The present invention provides a floor cleaner and a water sink structure thereof. In the present invention, a water sink is formed on a surface of a cleaning cylinder by a rotating roller, and a conventional water sink structure formed by a shell water sink and a filter screen is not required, so that the structure is simpler. Since a water outlet conduit and a water pumping conduit are arranged vertically to the surface of the cleaning cylinder, water is discharged and pumped on a surface of an outer sponge layer, the water supply and water pumping systems will not be blocked, and the water discharge effect and the water pumping effect are better.

8 Claims, 2 Drawing Sheets

FLOOR CLEANER AND WATER SINK STRUCTURE THEREOF

BACKGROUND OF THE INVENTION

The present invention relates to the technical field of cleaners, and in particular to a floor cleaner and a water sink structure thereof.

Floor cleaning tools used early are brooms, mops, floor wipers and the like. These tools complete the cleaning operation mainly by means of manual operations. With the progress of science and technology, people's requirements for the floor cleaning tools are also gradually increasing. Vacuum cleaners appear firstly which are energized by electric power and suck garbage, dust and the like on the floor by generating negative pressure. However, due to the limitation of their working principle, the vacuum cleaners cannot clean some garbage and dirt firmly attached to the floor, so new floor cleaners have appeared.

Automatic floor cleaning robots have gradually entered ordinary families. They not only undertake some housework, but also increase the joy of family life. A cleaning cylinder of the floor cleaner is driven to scrub the floor through the operation of the motor. The cleaning cylinder usually adopts a sponge cylinder structure. The cleaning capability of the floor cleaner is related to the thickness of the sponge cylinder. The thicker the sponge cylinder is, the stronger the cleaning ability is. Meanwhile, the floor cleaner is also equipped with a water supply system and a water sink to clean the cleaning cylinder, thus so as to clean the floor completely.

In order to clean the cleaning cylinder, a water sink communicated with the water supply system is generally provided, clean water is supplied to clean the cleaning cylinder, and waste water produced after cleaning the cleaning cylinder is pumped out. The existing floor cleaner generally uses a shell water sink, and a filter screen is provided on the water sink, thus forming a water sink structure. However, since the garbage on the cleaning cylinder enters the filter screen, the filter screen is easily blocked.

BRIEF SUMMARY OF THE INVENTION

In order to solve the above problems, the present invention provides a water sink structure for a floor cleaner, which does not need a conventional water structure formed by a shell water sink and a filter screen and will not result in blockage.

In addition, a floor cleaner using the water sink structure described above is further provided.

In order to achieve the above objective, the present invention employs the following technical solutions. A water sink structure for a floor cleaner is provided, including a cleaning cylinder and a rotating roller, wherein the rotating roller is disposed on a front side of the cleaning cylinder in parallel and forms an included angle with an upper end of the cleaning cylinder; the included angle between the rotating roller and the cleaning cylinder forms a water sink on a surface of the cleaning cylinder; the rotating roller squeezes the surface of the cleaning cylinder; a water outlet conduit is provided at one end of the water sink, while a water pumping conduit is provided at the other end thereof; and, both the water outlet conduit and the water pumping conduit are arranged vertically to the surface of the cleaning cylinder.

Further, the water sink structure for a floor cleaner further includes a driving device; one end of the rotating roller is in driving connection to the driving device; and, the driving device drives the rotating roller to rotate and brings the cleaning cylinder to roll towards the front side.

The driving device is a driving motor.

Further, the water sink structure for a floor cleaner further includes a fixed frame, with two ends of the cleaning cylinder and of the rotating roller being rotatably connected to the fixed frame, respectively.

Further, the cleaning cylinder includes a sleeve, an inner sponge layer and an outer sponge layer, the inner sponge layer is sleeved on a surface of the sleeve, and the outer sponge layer is sleeved on a surface of the inner sponge layer.

The inner sponge layer is a water-repellent sponge layer, the outer sponge layer is a water-absorbent sponge layer, and the thickness of the outer sponge layer is less than that of the inner sponge layer.

A distance from the water pumping conduit to the surface of the cleaning cylinder is 0.2 mm to 2.0 mm.

The present invention further includes a floor cleaner using the water sink structure described above.

The present invention has the following beneficial effects: in the water sink structure for a floor cleaner in the present invention, the water sink is formed on the surface of the cleaning cylinder by the rotating roller, and the conventional water sink structure formed by a shell water sink and a filter screen is not required, so that the structure is simpler. In the water supply system, water is supplied from one end of the water sink, and waste water is pumped out from the other end of the water sink. Since the water outlet conduit and the water pumping conduit are arranged vertically to the surface of the cleaning cylinder, water is discharged and pumped on the surface of the outer sponge layer. Waste water is pumped away from the surface of the outer sponge layer, and the garbage on the surface of the water sink will not be pumped away, so the water supply and water pumping systems will not be blocked, and the water discharge effect and the water pumping effect are better.

Reference numbers: 1: cleaning cylinder; 11: sleeve; 12: inner sponge layer; 13: outer sponge layer; 2: rotating roller; 3: included angle; 4: water sink; 41: water outlet conduit; 42: water pumping conduit; 5: driving device; 6: fixed frame; 7: garbage bin; 71: opening; 72: exhaust fan; 8: clean water tank; 9: waste water tank; and, 10: clean water supply device.

DETAILED DESCRIPTION OF THE INVENTION

The present invention will be further described below in detail by specific embodiments with reference to the accompanying drawings. The present application can be implemented in various different ways. The following specific embodiments are provided to facilitate a clearer and more thorough understanding of the disclosure of the present application. Words indicating orientation, such as front, rear, left and right, are merely used for indicating the position of the structure shown in the corresponding drawings.

Figure 1:
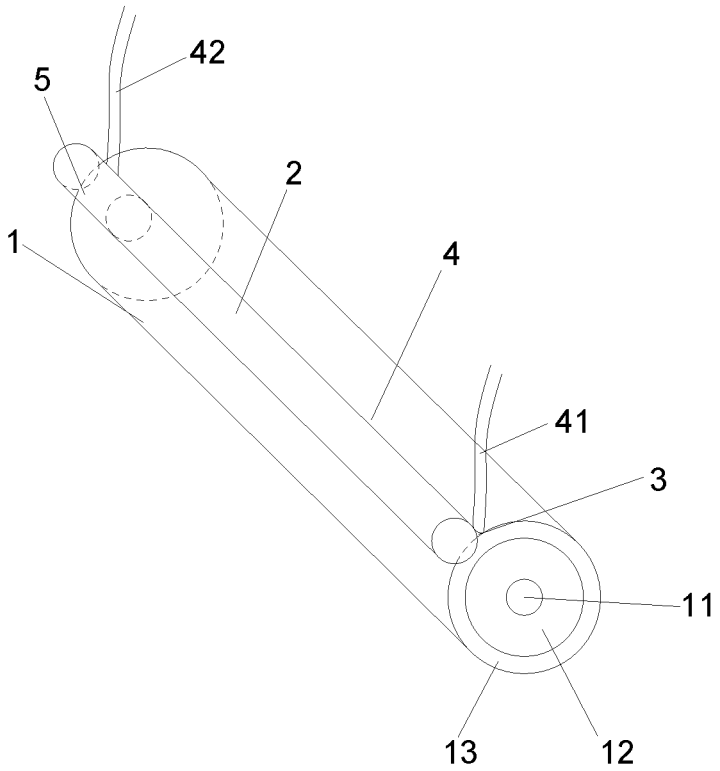
FIG. 1 is a schematic structural view of the present invention.
Figure 2:
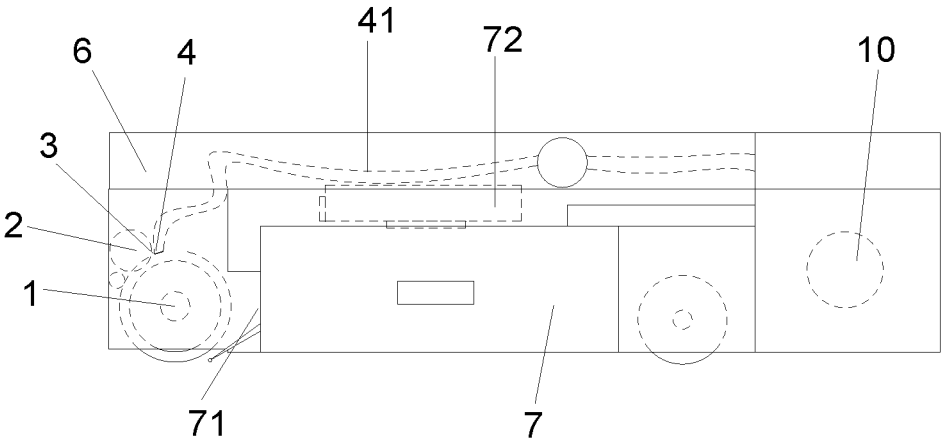
FIG. 2 is a schematic side view of a floor cleaner of a specific embodiment.

Referring to FIGS. 1-2, the present invention provides a water sink structure for a floor cleaner, including a cleaning cylinder 1 and a rotating roller 2. The rotating roller 2 is disposed on a front side of the cleaning cylinder 1 in parallel, and forms an included angle 3 with an upper end of the cleaning cylinder 1. The included angle 3 between the rotating roller 2 and the cleaning cylinder 1 forms a water sink 4 on the surface of the cleaning cylinder. The rotating roller 2 squeezes the surface of the cleaning cylinder 1. A water outlet conduit 41 is provided at one end of the water sink 4, while a water pumping conduit 42 is provided at the other end thereof. The water outlet conduit 41 and the water pumping conduit 42 are arranged vertically to the surface of the cleaning cylinder 1.

Compared with the prior art, in the water sink structure for a floor cleaner in the present invention, the water sink 4 is formed on the surface of the cleaning cylinder 1 by the rotating roller 2, and a conventional water sink structure formed by a shell water sink and a filter screen is not required, so that the structure is simpler. In the water supply system, water is supplied from one end of the water sink 4, and waste water is pumped out from the other end of the water sink 4. Since the water outlet conduit 41 and the water pumping conduit 42 are arranged vertically to the surface of the cleaning cylinder 1, water is discharged and pumped on the surface of the outer sponge layer 13. Waste water is pumped away from the surface of the outer sponge layer 13, and the garbage on the surface of the water sink 4 will not be pumped away, so the water supply and water pumping systems will not be blocked.

Further, the water sink structure further includes a driving device 5. One end of the rotating roller 2 is in driving connection to the driving device 5, and the driving device 5 drives the rotating roller to rotate and brings the cleaning cylinder 1 to roll towards the front side. The driving device 5 is a driving motor.

With the above solutions, the rotating roller 2 is driven to rotate by the driving motor so as to bring the cleaning cylinder 1 squeezed by the rotating roller 2 to roll, and water in the outer sponge layer 13 is squeezed out during the rolling process, thus waste water in the water sink 4 formed between the cleaning cylinder 1 and the rotating roller 2 is squeezed out.

Further, the water sink structure further includes a fixed frame 6. Both ends of the cleaning cylinder 1 and of the rotating roller 2 are rotatably connected to the fixed frame 6, respectively.

A garbage bin 7 is further provided below the rear side of the cleaning cylinder 1, an exhaust fan 72 is provided within the garbage bin 7, an opening 71 is formed at a lower part of one side of the garbage bin 7 corresponding to the water sink 4, and the exhaust fan 72 sucks garbage on the floor into the garbage bin 7 through the opening 71.

With the above solution, the opening 71 is formed at the lower part of the side of the garbage bin 7 corresponding to the water sink 4, and the exhaust fan 72 sucks garbage on the floor into the garbage bin 7 through the opening 71, so the blockage of the water sink 4 by garbage is avoided.

Further, the cleaning cylinder 1 includes a sleeve 11, an inner sponge layer 12 and an outer sponge layer 13. The inner sponge layer 12 is sleeved on the surface of the sleeve 11, and the outer sponge layer 13 is sleeved on the surface of the inner sponge layer 12. The inner sponge layer 12 is a water-repellent sponge layer, the outer sponge layer 13 is a water-absorbent sponge layer, and the thickness of the outer sponge layer 13 is less than that of the inner sponge layer 12.

A distance from the water pumping conduit 42 to the surface of the cleaning cylinder 1 is 0.2 mm to 2.0 mm.

With the above solution, the outer sponge layer 13 is made from a water-absorbent sponge material, and water is mainly absorbed by the outer sponge layer 13. Therefore, during the water squeezing process, it is only necessary to squeeze out water in the water-absorbent outer sponge layer. Moreover, since the thickness of the outer sponge layer 13 is less than that of the existing integral sponge layer, water can be squeezed out without a large squeezing force, and the rotation of the cleaning cylinder 1 will not be hindered. Even if the water pumping conduit 42 is blocked by fine impurities in water, the cleaning cylinder 1 can take away the impurities in the water pumping conduit 42 during its rotation.

In addition, a fixed roller (not shown) may be disposed on a rear side of the cleaning cylinder 1 in parallel, and the fixed roller is in contact with the surface of the cleaning cylinder 1, so that the garbage can be further prevented from entering the water sink 4 and it is convenient for the garbage bin 7 to absorb the garbage.

The present invention will be further described below by way of specific embodiments.

Figure 3:
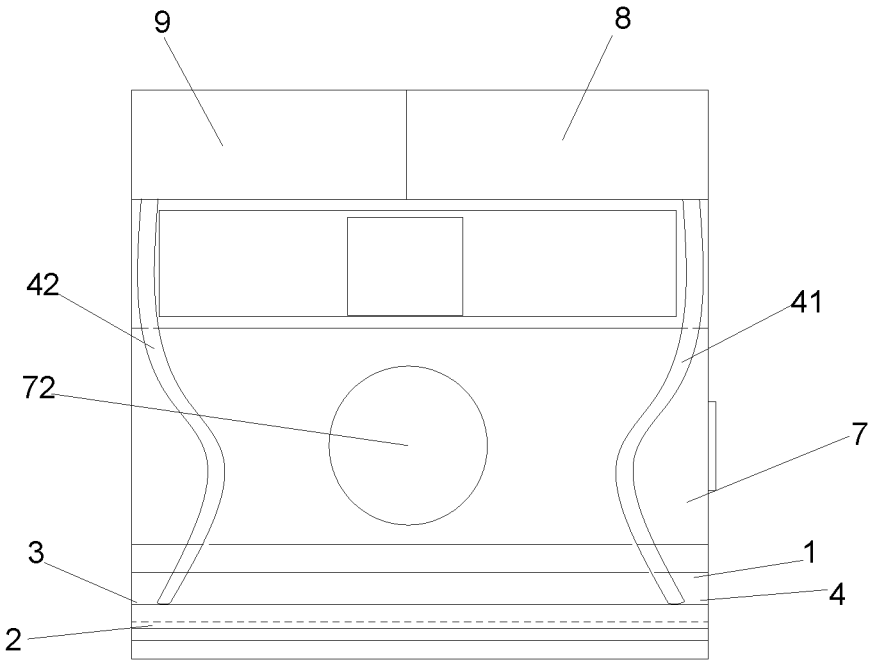
FIG. 3 is a schematic top view of the floor cleaner of a specific embodiment.

Referring to FIGS. 2 and 3, this specific embodiment provides a floor cleaner using the water sink structure described above, which further includes a clean water tank 8, a waste water tank 9, a clean water supply device 10, a garbage bin 7 and a body shell (not shown). The cleaning cylinder 1, the clean water tank 8, the waste water tank 9, the clean water supply device 10 and the garbage bin 7 are fixed to the body shell, respectively. The cleaning cylinder 1 and the rotating roller 2 are also rotatably fixed to the body shell. The rotating roller 2 is disposed on an upper side of the cleaning cylinder 1 in parallel, and fixed to the cleaning cylinder 1 in a squeezed manner. A water sink 4 is formed on the surface of the cleaning cylinder 1 by the rotating roller 2, and the rotating roller 2 can be driven to rotate by a driving motor in the driving device 5 and bring the cleaning cylinder 1 to roll towards the front side.

In this specific embodiment, both ends of the cleaning cylinder 1 and of the rotating roller 2 are connected to a rotating rod through bearings or sleeves, respectively, and then are rotatably connected to the body shell through the fixed frame 6. The garbage bin 7 is further provided below the rear side of the cleaning cylinder 1. An exhaust fan 72 is provided within the garbage bin 7, and an opening 71 is formed at a lower part of the side of the garbage bin 7 corresponding to the water sink 4. The exhaust fan 72 sucks garbage on the floor into the garbage bin 7 through the opening 71.

The cleaning cylinder 1 includes a sleeve 11, a water-repellent inner sponge layer 12 and a water-absorbent outer sponge layer 13. The inner sponge layer 12 is sleeved on the outer surface of the sleeve 11, the outer sponge layer 13 is sleeved on the surface of the inner sponge layer 12, and the thickness of the outer sponge layer 13 is less than that of the inner sponge layer 12.

In this specific embodiment, a control circuit board (not shown) is provided within the body shell of the floor cleaner, and a control key is provided on the surface of the body shell. A user activates the floor cleaner through the control key, thereby activating the driving motor to drive the rotating roller 2 to roll and bring the cleaning cylinder 1 to roll in an opposite direction. The clean water supply device 10 releases clean water at one end of the water sink 4 on the surface of the cleaning cylinder 1 through the water outlet conduit 41, and the water pumping conduit 42 pumps outs waste water at the other end of the water sink 4 on the surface of the cleaning cylinder 1. At this time, the exhaust fan 72 in the garbage bin 7 also operates to suck garbage at the lower part on the side of the water sink 4 from the opening 71 into the garbage bin 7.

After using the floor cleaner, the floor cleaner can be turned off by the control key and stop operating. The user can take out the waste water tank 9, pour out the waste water and install the waste water tank back to its original position. The user can also take out the garbage bin 7, dump the garbage and put the garbage bin back to its original position. In addition, the user can also take out the clean water tank 8 as required, and then add or pour out clean water. In this specific embodiment, the floor cleaner is simple in structure, does not cause garbage blockage, and has a good cleaning effect.

The foregoing implementations are merely used for describing the preferred implementations of the present invention, rather than limiting the scope of the present invention. Various modifications and improvements can be made to the technical solutions of the present invention by a person of ordinary skill in the art without departing from the design spirit of the present invention, and those modifications and improvements shall fall into the protection scope defined by the appended claims of the present invention.

What is claimed is:

1. A water sink structure for a floor cleaner, characterized by comprising a cleaning cylinder and a rotating roller, wherein the rotating roller is disposed on a front side of the cleaning cylinder in parallel and forms an included angle with an upper end of the cleaning cylinder; the included angle between the rotating roller and the cleaning cylinder forms a water sink on a surface of the cleaning cylinder; the rotating roller squeezes the surface of the cleaning cylinder; a water outlet conduit is provided at one end of the water sink, while a water pumping conduit is provided at the other end thereof; and, both the water outlet conduit and the water pumping conduit are arranged vertically to the surface of the cleaning cylinder.

2. The water sink structure for a floor cleaner according to claim 1, characterized by further comprising a driving device; one end of the rotating roller is in driving connection to the driving device; and, the driving device drives the rotating roller to rotate and brings the cleaning cylinder to roll towards the front side.

3. The water sink structure for a floor cleaner according to claim 2, characterized in that the driving device is a driving motor.

4. The water sink structure for a floor cleaner according to claim 1, characterized by further comprising a fixed frame, two ends of the cleaning cylinder and the rotating roller being rotatably connected to the fixed frame.

5. The water sink structure for a floor cleaner according to claim 1, characterized in that the cleaning cylinder comprises a sleeve, an inner sponge layer and an outer sponge layer, the inner sponge layer is sleeved on a surface of the sleeve, and the outer sponge layer is sleeved on a surface of the inner sponge layer.

6. The water sink structure for a floor cleaner according to claim 5, characterized in that the inner sponge layer is a water-repellent sponge layer, the outer sponge layer is a water-absorbent sponge layer, and the thickness of the outer sponge layer is less than that of the inner sponge layer.

7. The water sink structure for a floor cleaner according to claim 1, characterized in that a distance from the water pumping conduit to the surface of the cleaning cylinder is 0.2 mm to 2.0 mm.

8. A floor cleaner using the water sink structure according to claim 1.

* * * * *